US005429563A

United States Patent [19]

Engel et al.

[11] Patent Number: 5,429,563

[45] Date of Patent: Jul. 4, 1995

[54] COMBINATION EXERCISE APPARATUS

[75] Inventors: Timothy S. Engel, Mound; Stephen S. Peterson, Maple Grove; James R. Bostic, Watertown, all of Minn.

[73] Assignee: NordicTrack, Inc., Chaska, Minn.

[21] Appl. No.: 212,481

[22] Filed: Mar. 14, 1994

Related U.S. Application Data

[63] Continuation of Ser. No. 92,380, Jul. 16, 1993, abandoned, which is a continuation of Ser. No. 913,680, Jul. 14, 1992, abandoned, which is a continuation-in-part of Ser. No. 883,610, May 13, 1992, abandoned, and a continuation-in-part of Ser. No. 877,524, May 1, 1992, Pat. No. 5,226,866.

[51] Int. Cl.[6] ..... A63B 22/00; A63B 22/02; A63B 22/04

[52] U.S. Cl. ..... 482/54; 482/51; 482/70

[58] Field of Search ..... 482/51, 52, 53, 54, 482/70, 71, 114, 115, 118, 148

[56] References Cited

U.S. PATENT DOCUMENTS

| | | | |
|---|---|---|---|
| 4,659,077 | 4/1987 | Stropkay | 482/51 |
| 5,110,117 | 5/1992 | Fisher et al. | 482/54 |
| 5,145,481 | 9/1992 | Friedeback | 482/70 |
| 5,226,866 | 7/1993 | Engel et al. | 482/70 |
| 5,295,928 | 3/1994 | Rennex | 482/51 |

FOREIGN PATENT DOCUMENTS

| | | | |
|---|---|---|---|
| 0235030 | 4/1986 | Germany | 482/54 |

*Primary Examiner*—Stephen R. Crow
*Attorney, Agent, or Firm*—Merchant & Gould

[57] ABSTRACT

The present invention provides an apparatus that selectively facilitates exercises that approximate the motions involved in walking and cross-country skiing. A base extends from a front end to a rear end, and a treadmill is operatively mounted relative to the base. Each of a pair of foot skates is selectively placed in rolling engagement with an upwardly facing portion of the treadmill or upper treadmill surface. Each of the pair of foot skates includes a one-way clutch roller for rolling forward relative to the upper treadmill surface and preventing rolling rearward relative to the upper treadmill surface. Thus, rearward movement of either skate requires coincidental rearward movement of the upper treadmill surface.

20 Claims, 11 Drawing Sheets

26
29
28
27
22
21
20
18
19
11
12
59
58
79
78
37
43
35
34
9

27
28
26
30
31
20
21
18
19
32
33
6
5
9

FIG. 6
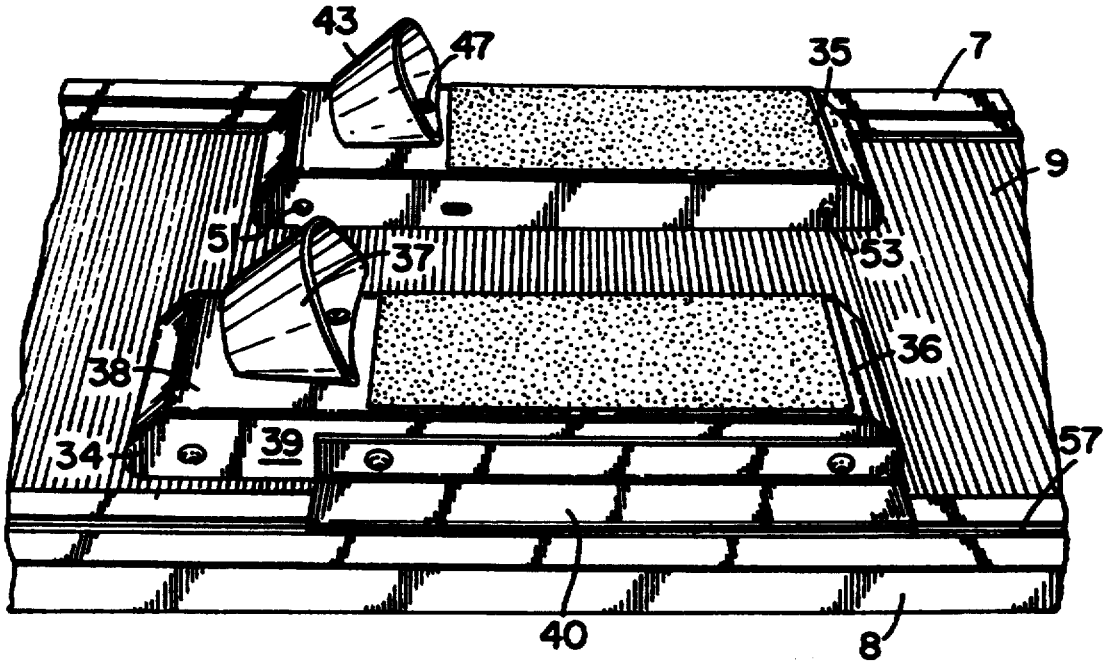
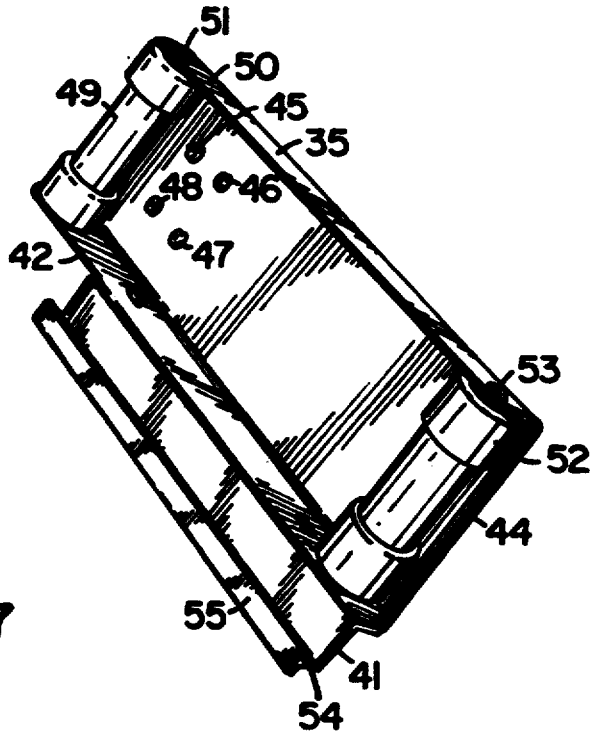
FIG. 7

COMBINATION EXERCISE APPARATUS

CROSS-REFERENCE TO RELATED PATENT APPLICATIONS

This patent application is a continuation of abandoned U.S. patent application Ser. No. 08/092,380, filed Jul. 16, 1993 which is a continuation of U.S. patent application Ser. No. 07/913,680, filed Jul. 14, 1992, (now abandoned), which is a continuation-in-part of U.S. patent application Ser. No. 07/883,610, filed May 12, 1992, (now abandoned) and U.S. patent application Ser. No. 07/877,524, filed May 1, 1992, (now U.S. Pat. No. 5,226,866).

FIELD OF THE INVENTION

The present invention relates to exercise apparatus and more particularly, to an apparatus that selectively facilitates exercises that approximate the motions involved in walking and cross-country skiing.

BACKGROUND OF THE INVENTION

Numerous treadmills have been developed to facilitate exercise that approximates walking motions, and numerous striding devices have been developed to facilitate exercise that approximates cross-country skiing motions. An object of the present invention is to provide a combination exercise apparatus that selectively simulates both the motions involved in walking and the motions involved in cross-country skiing.

SUMMARY OF THE INVENTION

The present invention includes a base that extends from a front end to a rear end. A treadmill is operatively mounted relative to the base, such that the treadmill lies within the dimensions of the base. A person standing on the treadmill can exercise in a manner that approximates walking.

Right and left foot skates are selectively placed in rolling engagement with the treadmill. The skates include one-way clutch rollers that allow the skates to roll forward relative to the treadmill, but prevent the skates from rolling rearward relative to the treadmill. In a preferred embodiment, right and left skate tracks are disposed on opposite sides of the treadmill to guide the skates in straight paths back and forth along opposite sides of the base. A person supported on the skates can exercise in a manner that approximates cross-country skiing.

The preferred embodiment further includes right and left foot pedals pivotally mounted relative to the base proximate its front end. A person supported on the pedals can exercise in a manner that approximates stair stepping. A stanchion extends upward from the base proximate its front end, and a body support is mounted relative to the stanchion to selectively support a person's body. An arm exerciser is mounted relative to the stanchion to facilitate isotonic arm exercise that may be performed in conjunction with walking, cross-country skiing, or stair stepping exercises.

BRIEF DESCRIPTION OF THE DRAWING

In the Drawing, wherein like numerals represent like parts and assemblies throughout the several views.

FIG. 6 is an enlarged perspective view of the foot skates operably associated with the apparatus shown in FIG. 1 in accordance with the present invention;

FIG. 7 is a perspective view of the underside of the right foot skate shown in FIG. 6;

DETAILED DESCRIPTION OF A PREFERRED EMBODIMENT

Figure 1:
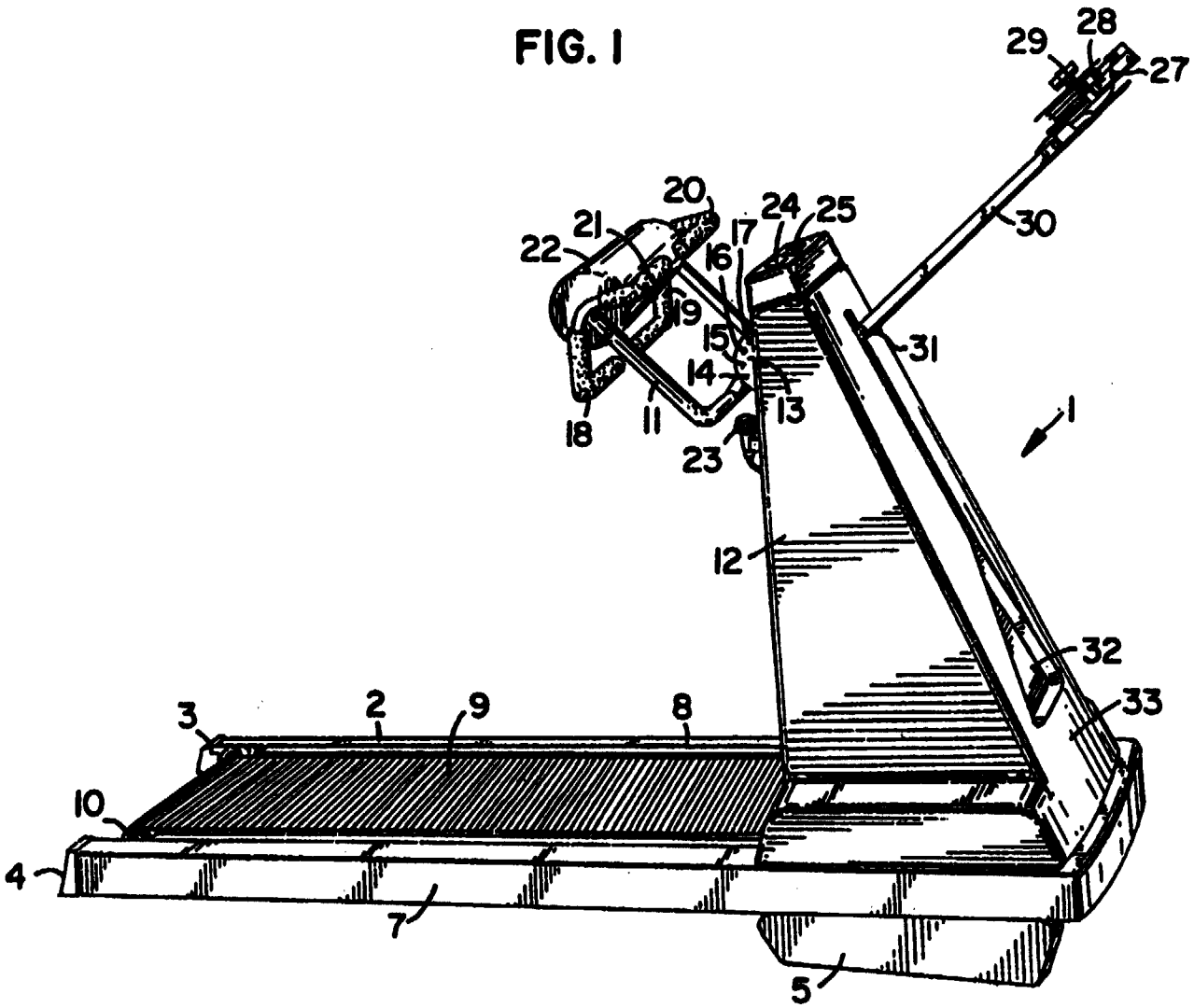
FIG. 1 is a perspective view of a combination exercise apparatus constructed in accordance with the principles of the present invention.

A combination exercise apparatus constructed according to the principles of the present invention is designated as 1 in FIGS. 1-5 and 13. The apparatus 1 includes a substantially planar base portion 2 having a rear end supported by pads 3 and 4 and a front end supported by base supports 5 and 6. The relative sizes and locations of the pads 3 and 4 and the base supports 5 and 6 are such that the base is supported in an uphill orientation relative to a floor surface on which the pads and supports rest.

The base 2 includes side members 7 and 8 which extend substantially from the front to the rear of the base. A tread 9 is disposed between the front and rear ends of the base 2 and between the side members 7 and 8. Thus, the tread 9 may be said to be disposed within the dimensions or planform of the base. The tread 9 is a continuous loop of resilient material that is supported by a spool 10 proximate the rear of the base and by another spool proximate the front of the base. A low friction platform is secured to the base 2 and extends substantially between the spools beneath the upwardly facing portion of the tread 9. The platform provides support for an upwardly facing portion of the tread 9 and anyone on the tread. The tread 9 is rotatably mounted relative to the base 2 and cooperates therewith to function as a treadmill for a person wishing to engage in walking and/or running exercises. As a person walks or runs on the treadmill, the upper surface of the tread 9 moves rearward while the person remains substantially in place relative to the length of the base 2.

A stanchion or pedestal 12 extends upward from a forward portion of the base 2. A support 11 extends rearwardly from an upper portion of the pedestal 12 to provide both handholds 18–21 and a pelvis engaging pad 22 for persons who may require assistance in maintaining their balance and position on the treadmill. The support 11 is pivotally secured to the pedestal 12 and may be secured in any of several orientations 14–17 about hub 13. A person exercising on the treadmill may grasp any of the handles 18–21 and/or rest his or her pelvis against the pad 22 to the extent necessary or desirable.

Figure 13:
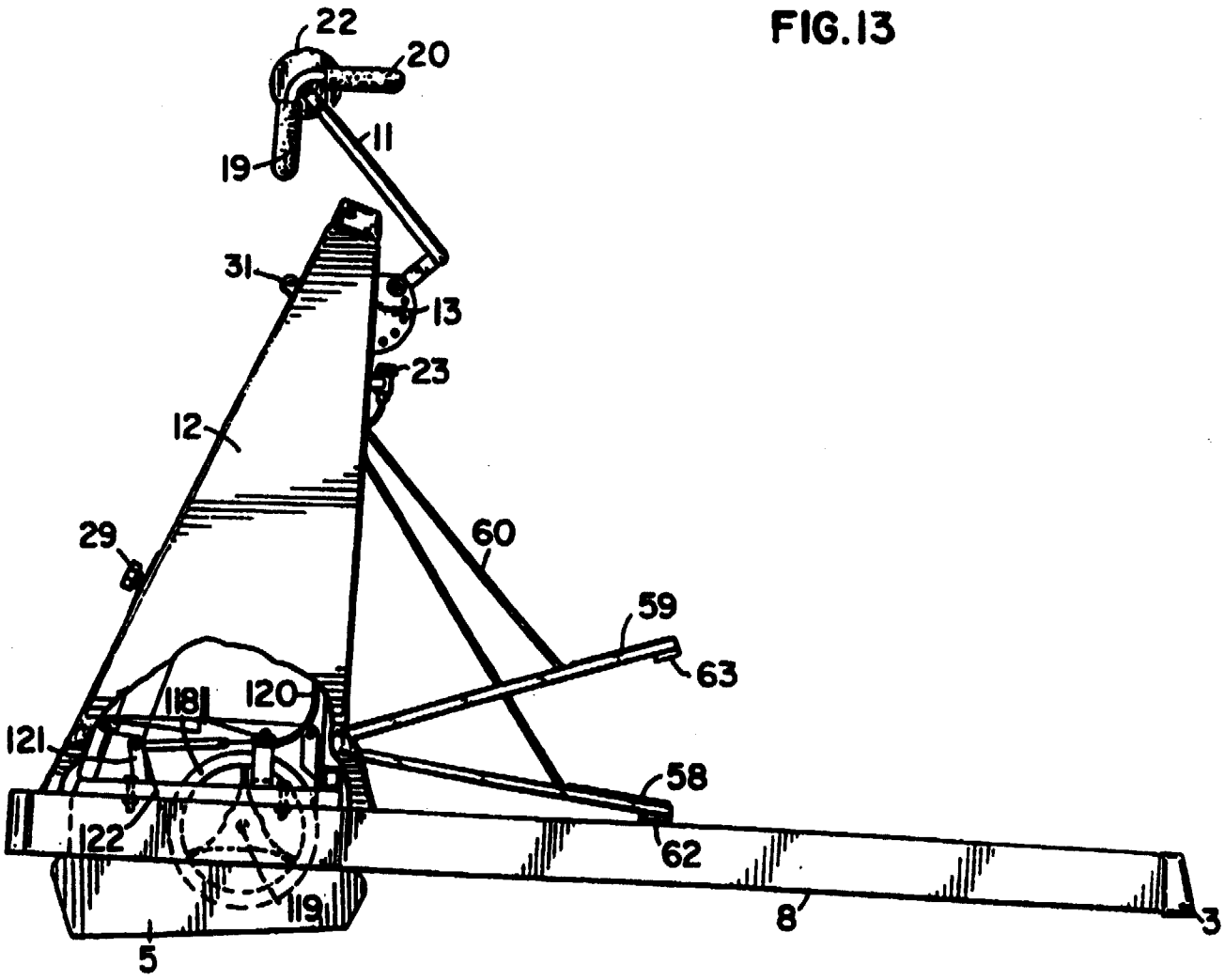
FIG. 13 is a left side view of the apparatus shown in FIG. 1, with a pair of pivoting foot pedals associated therewith in accordance with the present invention.

As shown in FIG. 13, a flywheel 118 is mounted on an axle 119. The front roller that supports the tread 9 is also mounted on the axle 119, and the flywheel 118 rotates contemporaneously with the tread 9. A drag strap 122 is disposed about a circumferential portion of the flywheel 118 and cooperates with the flywheel to provide resistance to treadmill movement. The drag strap 122 is operatively connected to a lever assembly 121 in such a manner that movement of the lever assembly 121 alters the tension in the drag strap 122, thereby altering the resistance to treadmill movement. A cable 120 is operatively connected to the lever assembly 121 and extends to a user manipulated knob 23 mounted on an upper portion of the pedestal 12. A person wishing to adjust the resistance to treadmill movement simply turns the knob 23 to adjust the tension in the drag strap 122. Exercise parameters, which may include work performed and/or energy expended, as derived from tension in the drag strap, are conveniently displayed on indicators 24 and 25 mounted on top of the pedestal 12.

An arm 30 is pivotally mounted to a flange 31 mounted on an upper portion of the pedestal 12. In an operative position, shown in FIGS. 1–5, the arm 30 extends upward and forward from the pedestal 12. A drum 28 is rotatably mounted on an upper end of the arm 30, and a pair of cords 26 and 27 are wound about the drum 28. A person walking or running on the treadmill may also pull the cords 26 and 27 in reciprocating fashion to rotate the drum 28 subject to frictional resistance. A user manipulated knob 29 shares an axis with and extends from the drum 28. A person wishing to adjust the resistance to arm exercise simply turns the knob to adjust the pressure between friction pads on the drum 28. The arm exerciser assembly is pivotable to a storage position within a recess 32 formed in a front lower portion 33 of the pedestal 12.

Figure 4:
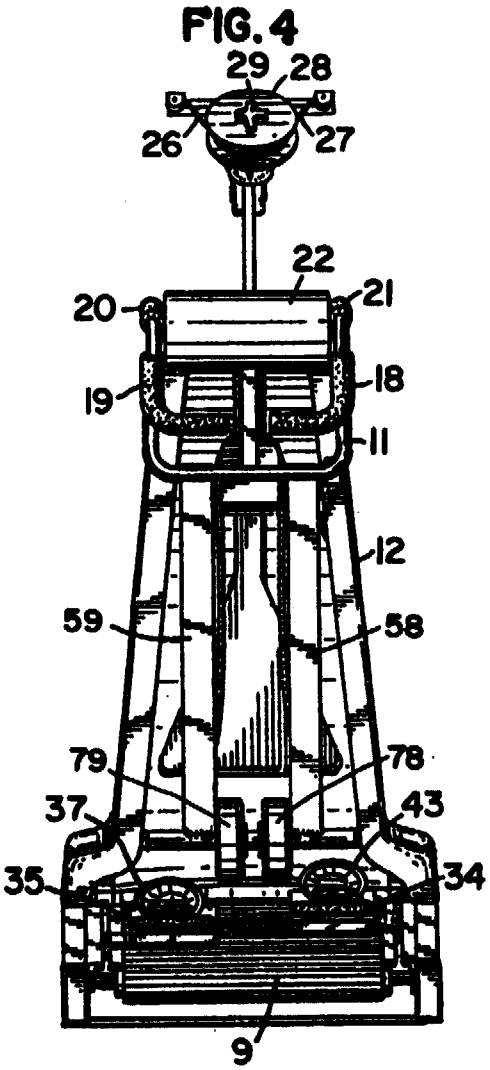
FIG. 4 is a rear view of the apparatus shown in FIG. 3.
Figure 2:
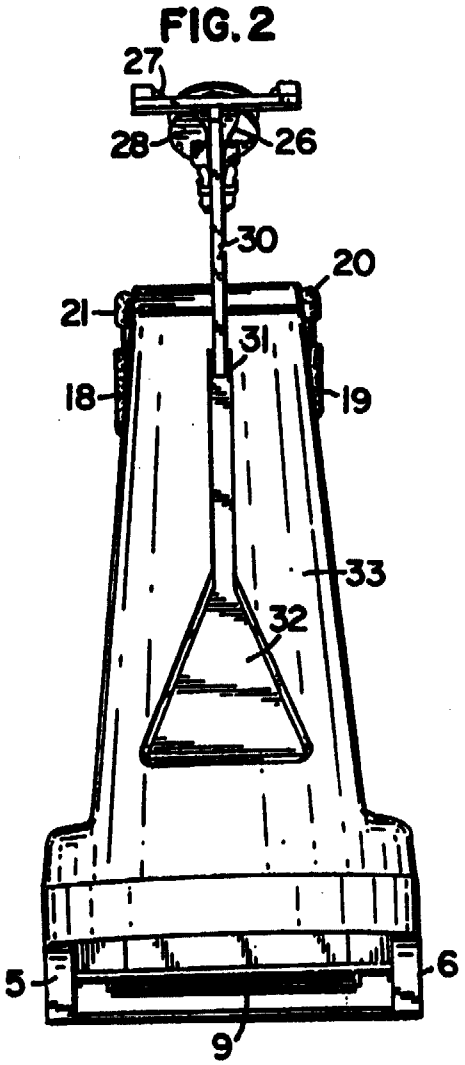
FIG. 2 is a front view of the apparatus shown in FIG. 1.
Figure 3:
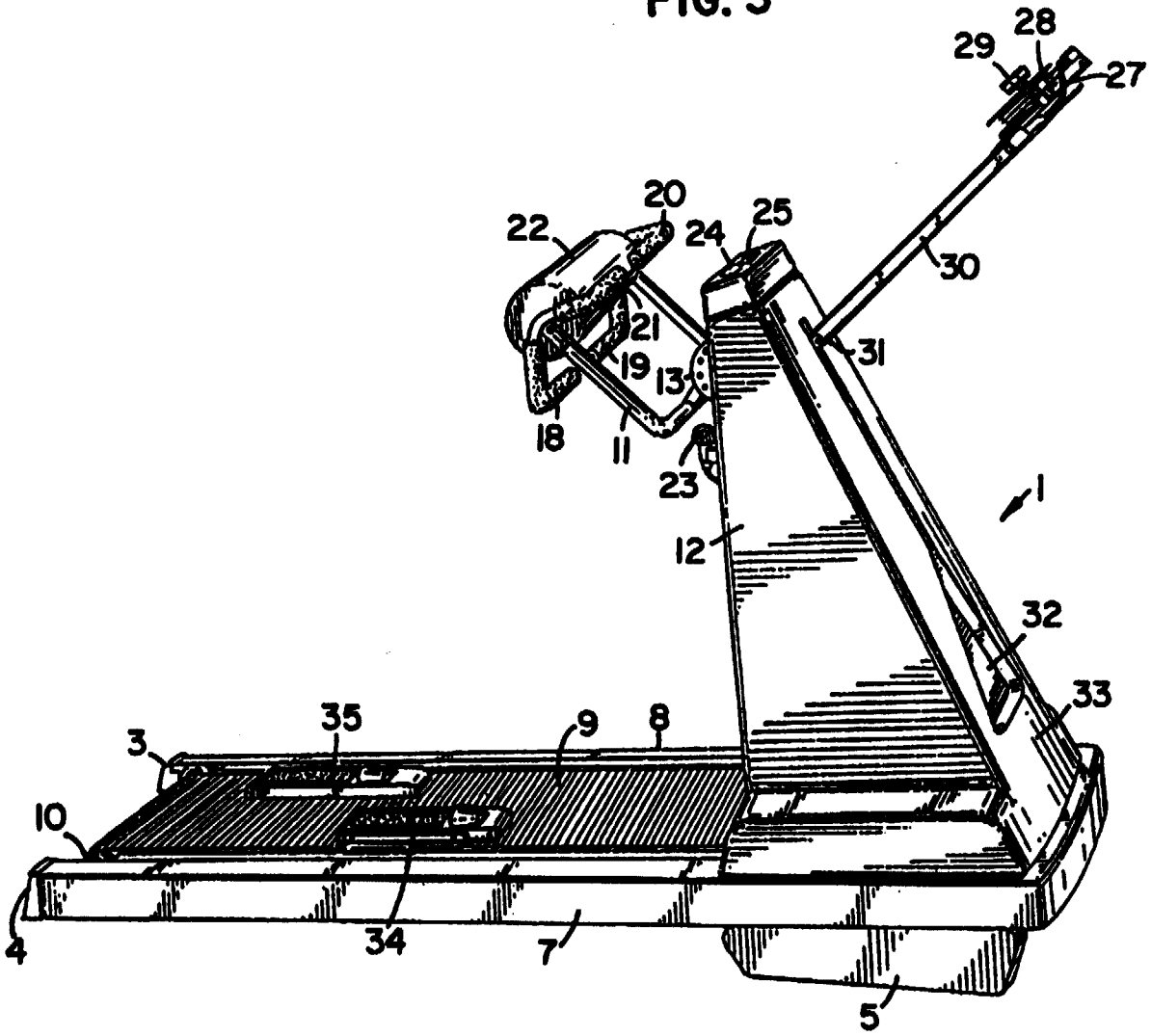
FIG. 3 is a perspective view of the apparatus shown in FIG. 1, with foot skates operably associated therewith in accordance with the present invention.
Figure 5:
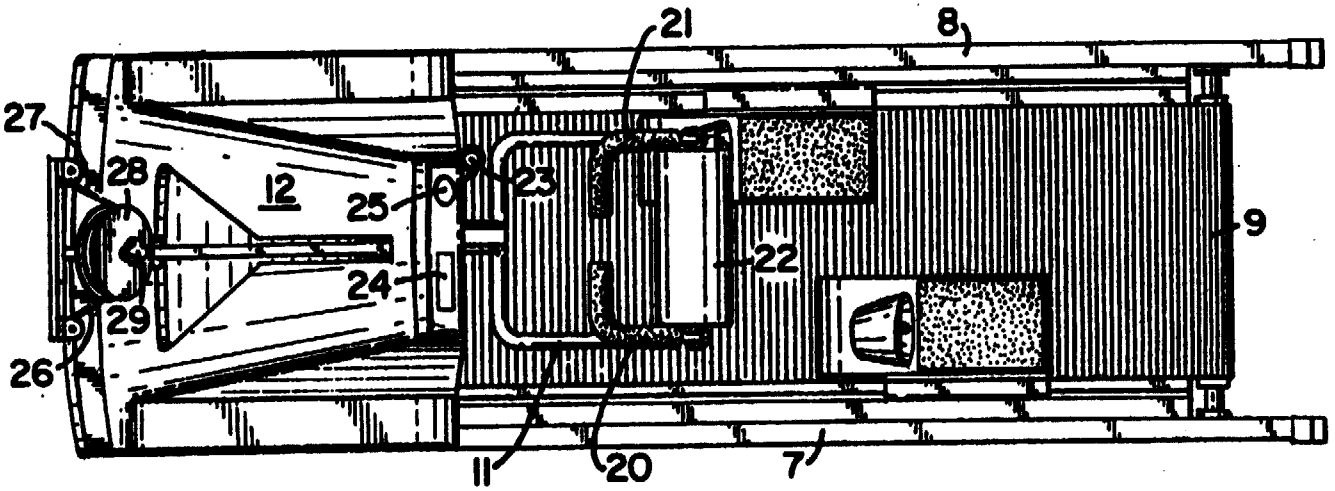
FIG. 5 is a top view of the apparatus shown in FIG. 3.
Figure 8:
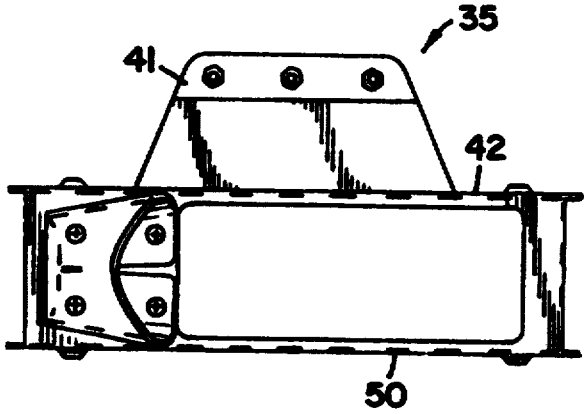
FIG. 8 is a top view of the skate shown in FIG. 7.
Figure 9:
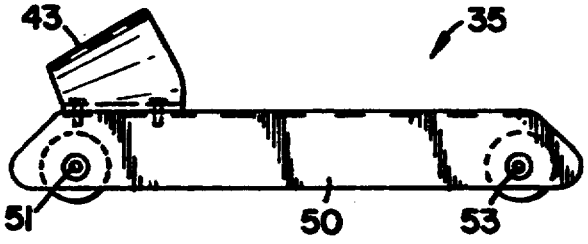
FIG. 9 is a left side view of the skate shown in FIG. 7.

The apparatus 1 is shown in a second operative configuration in FIGS. 3–5. Whereas a first operative configuration, shown in FIG. 1, facilitates exercises that approximate the motions of walking and/or running, the second operative configuration facilitates exercise that approximates the motions of cross-country skiing. In this cross-country skiing configuration, a right foot skate 34 and a left foot skate 35 are disposed on the upper surface of the tread 9. The right and left foot skates are mirror images of one another. As shown in FIG. 6 with reference to the left foot skate 34, each foot skate includes a relatively resilient, high friction foot supporting surface 36, and a toe holster or restraint 37 disposed on a planar member 38 in front of the foot supporting surface 36. As shown in FIG. 7 with reference to the right foot skate 35, the toe holster 43 is secured to the planar member 44 by means of bolts 45–48.

Figure 10:
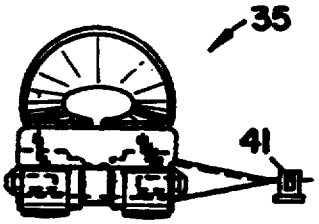
FIG. 10 is a rear view of the skate shown in FIG. 7.
Figure 11:
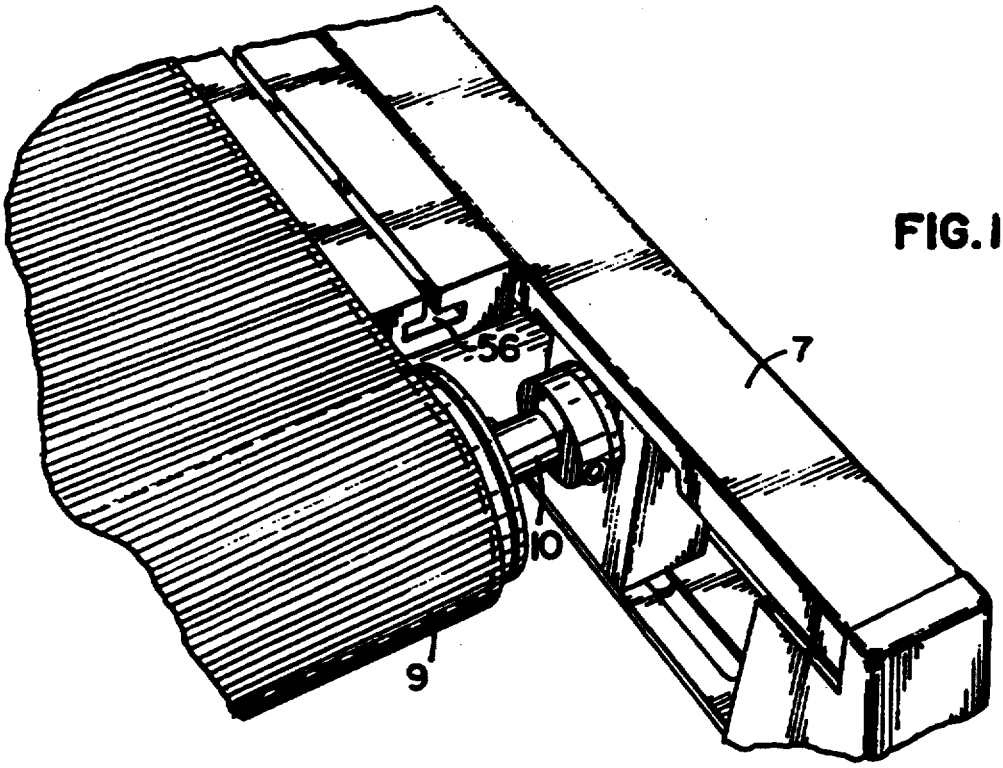
FIG. 11 is an enlarged perspective view of a right rear portion of the apparatus shown in FIG. 1.

As shown in FIGS. 6–10 with reference to the right foot skate 35, each skate includes a front axle 51 that extends between side walls 42 and 50 and supports a front wheel assembly and one-way clutch roller means 49, and each skate includes a rear axle 53 that extends between side walls 42 and 50 and supports a rear wheel assembly and one-way clutch roller means 52. Each skate 34 and 35 also includes a flange 40 and 41, respectively, that extends outwardly to guide the skate along a respective side member 7 or 8. As shown in FIGS. 7 and 10 with reference to the right foot skate 35, each flange 41 includes a downwardly extending portion 54 and a laterally extending portion 55 that cooperate to define an inverted, substantially T-shaped rail. The rail is sized and configured to mate with an inverted, substantially T-shaped track or channel 56 disposed on either side of the tread 9, as shown in FIG. 11. Those skilled in the art will recognize that the present invention is not limited to a T-shaped mating arrangement, but rather, that other mating configurations, for example, L-shaped, would also work. The rear end of each T-shaped channel is open-ended and accessible to facilitate insertion and removal of the T-shaped rail on a respective foot skate. As can be seen from FIG. 5, the tracks constrain the foot skates to move in straight paths forward and backward relative to the base 2.

Figure 12:
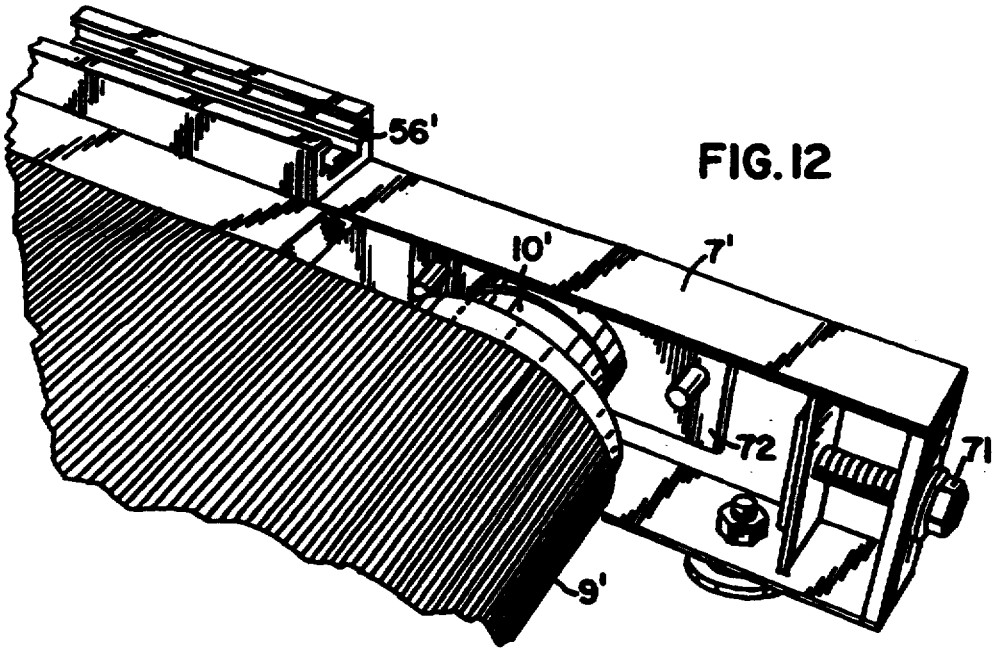
FIG. 12 is an enlarged perspective view of a right rear portion of another embodiment of the present invention.

An alternative embodiment of the present invention is shown in FIG. 12. This alternative embodiment is similar to the apparatus 1 except to the extent shown in FIG. 12. In particular, the skate track or channel 56' is positioned above the respective side member 7', rather than inwardly adjacent the side member 7 on the apparatus 1. Also, the tread 9' is supported by a rear roller 10' that is rotatably mounted to a bracket 72, which in turn, is movably mounted to the side member 7' by means of a threaded bolt 71. Rotation of the bolt 71 causes the bracket 72 to travel along the side member, thereby adjusting tension in the tread 9'.

The one-way clutch roller means are designed to allow the foot skates to roll forward relative to the tread 9 but to prevent the skates from rolling rearward relative to the tread 9. As a result, any rearward movement of either skate requires a coincidental rearward movement of the upper surface of the tread 9 and thus, is subject to resistance provided by the flywheel and drag strap assembly. Thus, a person supported on the skates can move his or her feet forward with minimal effort, but must drive the treadmill in order to move either foot rearward. This shuffling exercise approximates the motions of cross-country skiing, particularly when performed in conjunction with the aforementioned arm exercises. Alternatively, a person may exercise only the lower body simply by grasping any of the handholds 18–21 while shuffling his or her feet back and forth.

Figure 14:
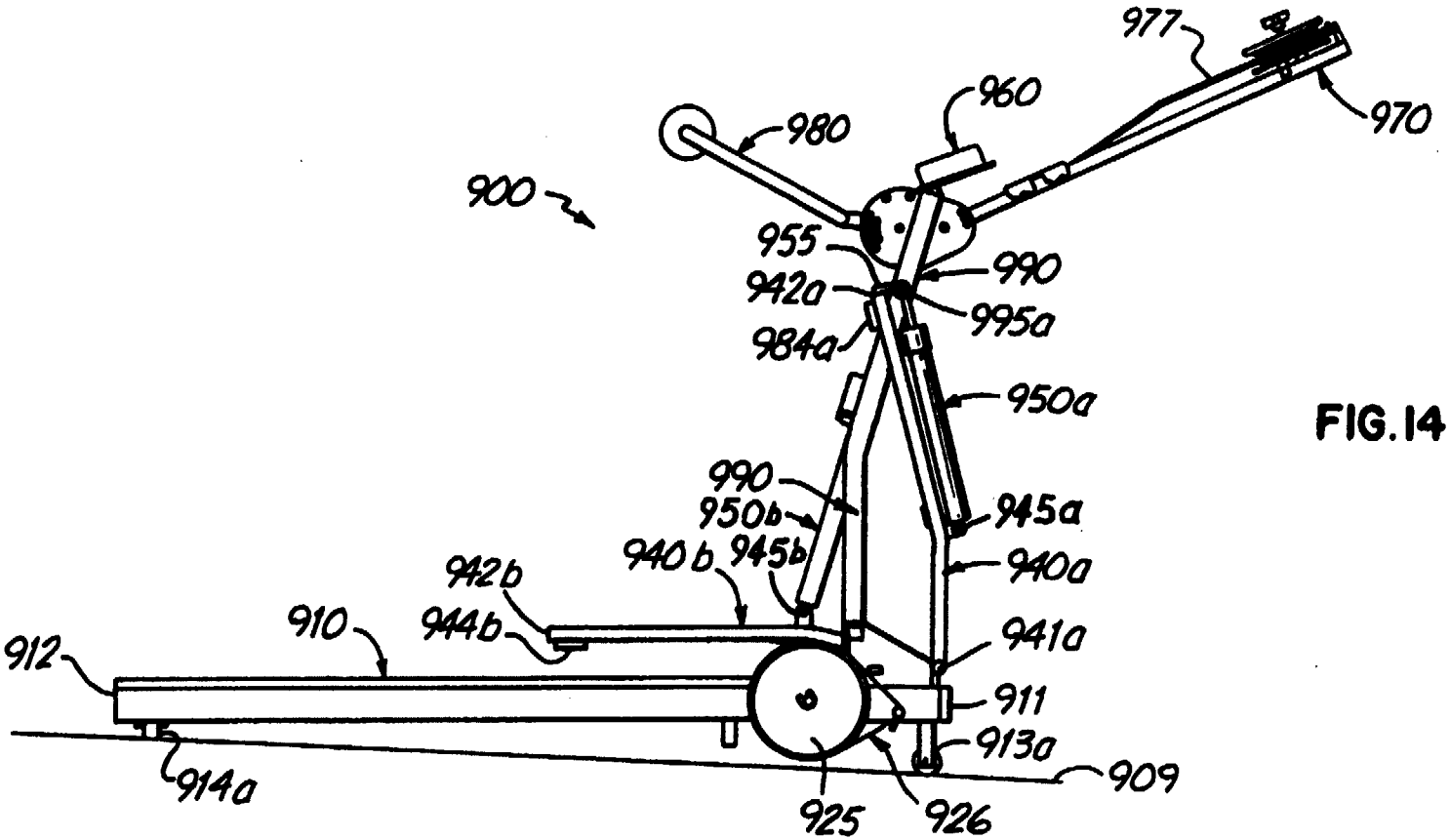
FIG. 14 is a side view of another combination exercise apparatus constructed in accordance with the present invention.
Figure 15:
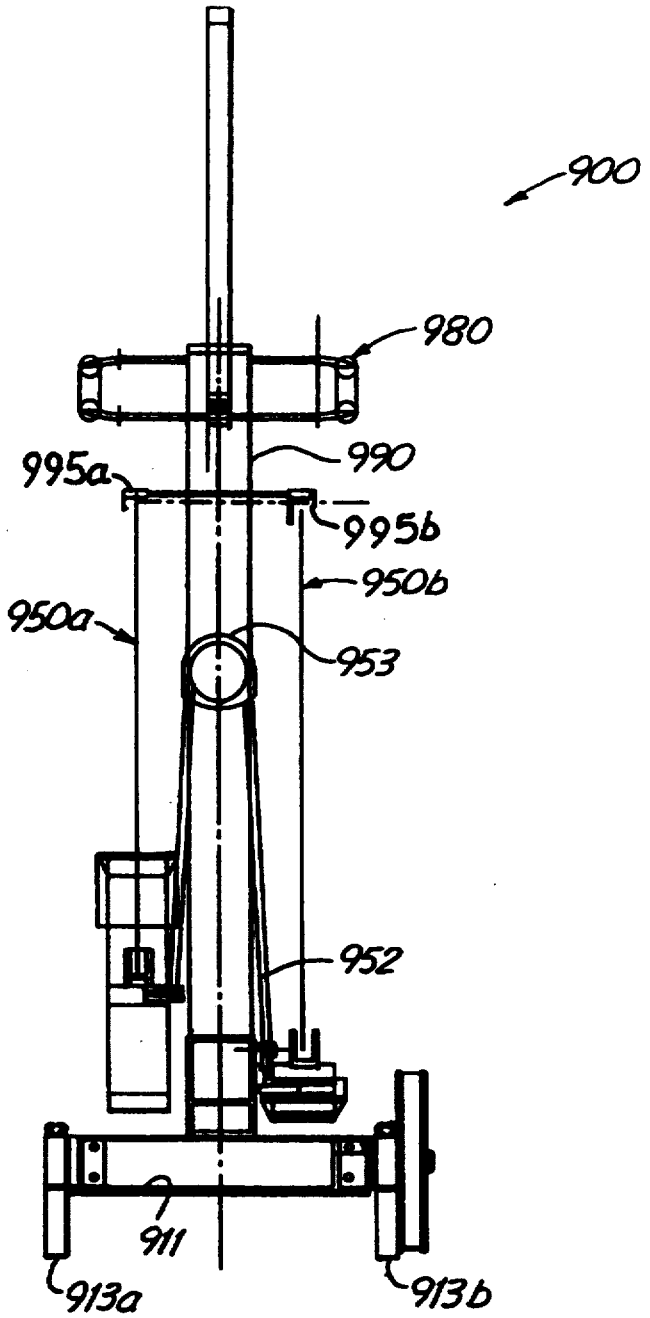
FIG. 15 is a rear view of the apparatus shown in FIG. 14.

The apparatus 1 is shown in a third operative configuration in FIG. 13. Whereas the first operative configuration facilitates exercises that approximate the motions of walking and/or running, and the second operative configuration facilitates exercise that approximates the motions of cross-country skiing, the third operative configuration facilitates exercise that approximates the motions of stair climbing. In this stair climbing configuration, the foot skates are moved to the rear of the tread 9 or are removed from the apparatus 1 altogether. A right foot pedal 58 and a left foot pedal 59 are pivotally mounted relative to the pedestal 12 proximate a front portion of the base 2. The right and left foot pedals are mirror images of one another. The foot pedals 58 and 59 are interconnected by a strap 60, which passes over a pulley in such a manner that the pedals move up and down in reciprocating fashion. Resistance to pivoting of the pedals may be provided in any of several different manners, including for example, frictional resistance means 78 and 79, as shown in FIG. 4, or hydraulic resistance means 950*a* and 950*b*, as shown in FIGS. 14–15 and discussed below with reference to a preferred embodiment of the present invention.

As shown in FIGS. 14–17, the preferred embodiment 900 is similar in many respects to the apparatus 1. The preferred embodiment 900 generally includes a base 910 that extends from a front end 911 to a rear end 912. The base is supported above a floor surface 909 by front legs 913*a* and 913*b* and rear legs 914*a* and 914*b*, which are secured to the front and rear ends 911 and 912, respectively. Each of the front legs 913*a* and 913*b* has a lower portion that telescopes relative to an upper portion. Each lower portion is supported by a roller 915 in contact with the floor surface 909, and each lower portion is selectively secured relative to a respective upper portion by means of a detent pin that passes through aligned holes in the leg portions. The telescoping front legs 913*a* and 913*b* allow for an adjustment of five to ten degrees in the inclination of the base 910 relative to the floor surface 909. Regardless of the degree of adjustment, the front legs 913*a* and 913*b* are effectively longer than the rear legs 914*a* and 914*b*, and thus, the base may be said to be uphill oriented from the perspective of a person supported on the base and facing forward.

Figure 16:
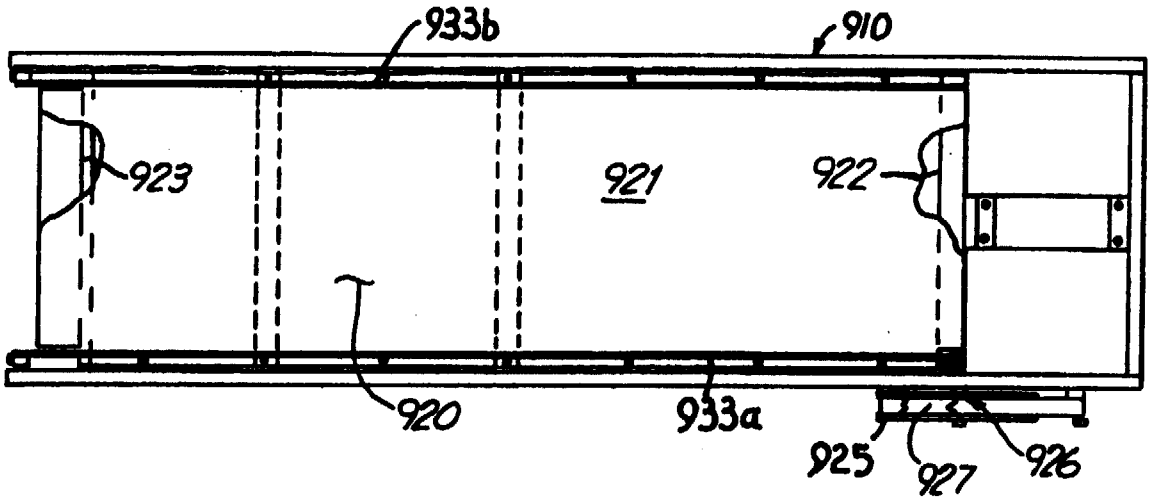
FIG. 16 is a top view of a treadmill portion of the apparatus shown in FIG. 14.
Figure 17:
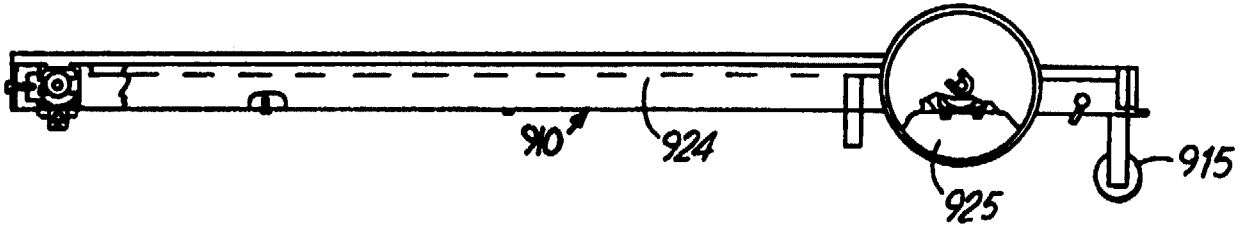
FIG. 17 is a right side view of the treadmill portion shown in FIG. 16.

As shown in FIGS. 16–17, a treadmill 920 is operatively mounted relative to the base 910 and lies within the planform or dimensions of the base 910. The treadmill 920 includes a continuous loop or belt 921 that extends around a forward roller 922 and a rearward roller 923, as well as a low friction supporting surface 924 disposed therebetween and beneath the upwardly facing portion of the belt 921.

A flywheel 925 is mounted to the shaft that supports the front roller 922 of the treadmill 920, and the flywheel 925 rotates together with the front roller 922. A drag strap 926 is disposed about a circumferential contact surface 927 on the flywheel 925. The flywheel 925 rotates subject to resistance caused by friction between the drag strap 926 and the contact surface 927 on the flywheel 925. Thus, the flywheel 925 and the drag strap cooperate to function as a treadmill resistance means that provides resistance to movement of the treadmill 920 relative to the base 910.

Right and left foot skates, identical to those shown and described with reference to the apparatus 1, are selectively placed in rolling engagement with the treadmill 920. Each of the skates includes one-way clutch roller means that allow the skates to roll forward relative to the treadmill, but prevent the skates from rolling rearward relative to the treadmill. Right and left foot skate tracks 933*a* and 933*b* are disposed outside opposite sides of the treadmill 920 and cooperate with the skates in a manner similar to those discussed above with reference to the apparatus 1. However, in this preferred embodiment 900, stops are provided proximate the rear ends of the skate tracks to prevent the skates from accidentally disengaging the tracks. The tracks 933*a* and 933*b* have channels that are sized and configured to receive mating members on the skates in order to guide the skates in straight paths along opposite sides of the treadmill 920. A person supported on the skates can simply roll the skates forward over the treadmill surface. However, when the person attempts to roll either skate rearward over the treadmill surface, the one-way clutch roller means lock, and the treadmill surface is pulled rearward together with the skate.

The preferred embodiment 900 further includes a stanchion 990, a body support 980, and an arm exerciser 970, all of which are functionally similar to those discussed above with reference to the apparatus 1. The arm exerciser 970 is similar to that shown in U.S. Pat. No. 4,728,102, which is owned by the assignee of the present invention. In the preferred embodiment 900, the bar that supports the arm exerciser can be secured in one of several orientations relative to the stanchion to allow variation in the motions involved in pulling on the force resistant line means 977. A performance monitor and display 960 is mounted on an upper of the stanchion 990. The monitor and display means 960 displays information derived from the exercise being performed on the exercise apparatus 900.

The preferred embodiment further provides a stair climbing mode of operation similar to that discussed above with reference to the apparatus 1. Each of a pair of foot pedals 940*a* and 940*b* extends from a respective pivot end 941*a* and 941*b* to a respective distal end 942*a* and 942*b*. The pivot ends 941*a* and 941*b* are pivotally mounted relative to the base 910 proximate its front end 911. A distal portion of each foot pedal 940*a* and 940*b* supports a respective foot pad having a non-skid surface.

A respective intermediate portion 945*a* and 945*b* of each foot pedal 940*a* and 940*b* is secured to a respective shock absorber 950*a* and 950*b* that serves as a resistance means. The shock absorbers or hydraulic cylinders 950*a* and 950*b* provide resistance that is adjustable by rotating a cap member on each cylinder, as disclosed in U.S. Pat. No. 4,591,032. Each shock absorber extends from a first end rotatably mounted to respective foot pedal 930*a* and 930*b* to a second end rotatably mounted to a respective lateral bar 995*a* and 995*b* extending from the stanchion 990. The foot pedals 930*a* and 930*b* are interconnected by a cord 952 that extends from an intermediate portion of the right foot pedal up and round a pulley 953 on the stanchion 990 and back down to an intermediate portion of the left foot pedal. With the foot pedals in an operative position, a person supported on the foot pedals shifts his or her weight from one foot to the other to drive the foot pedals in reciprocating fashion and subject to the resistance provided by the hydraulic cylinders.

For storage purposes, the foot pedals 940*a* and 940*b* are pivotable to an extreme upward position, wherein the distal end 942*a* and 942*b* of each foot pedal is proximate a respective lateral bar 995*a* and 995*b* extending from the stanchion 990. Latch mechanisms 955 on the lateral bars rotate into and engage recesses in the distal ends of the foot pedals to lock the foot pedals in the extreme upright position, as shown in FIG. 14 with reference to the right foot pedal 940*a*.

Although the present invention has been described with reference to particular embodiments and applications, those skilled in the art will recognize additional embodiments and applications that fall within the scope of the present invention. Accordingly, the present invention is to be limited only by the appended claims.

We claim:

1. An exercise apparatus, comprising:

a base extending from a front end to a rear end;

a treadmill operatively mounted relative to said base and within the dimensions of said base;

a right foot skate selectively in rolling engagement with said treadmill, wherein said right foot skate includes one-way clutch roller means for rolling forward relative to said treadmill and preventing rolling rearward relative to said treadmill; and a left foot skate selectively in rolling engagement with said treadmill, wherein said left foot skate includes one-way clutch roller means for rolling forward relative to said treadmill and preventing rolling rearward relative to said treadmill.

2. An exercise apparatus according to claim 1, further comprising:

a stanchion extending upward from said base proximate said front end;

a body support means, mounted relative to said stanchion, for selectively supporting a person's body; and an arm exerciser means, mounted relative to said stanchion, for facilitating isotonic arm exercise.

3. An exercise apparatus according to claim 2, wherein said arm exerciser means includes reciprocating right and left force resistant line means that oppose pulling motion away from said arm exerciser means.

4. An exercise apparatus according to claim 1, further comprising a treadmill resistance means, operatively connected to said treadmill, for resisting movement of said treadmill relative to said base.

5. An exercise apparatus according to claim 4, wherein said treadmill resistance means includes a flywheel secured relative to a roller that supports said treadmill, and said flywheel has a circumferential contact surface in contact with a drag strap, and rotation of said roller is subject to frictional resistance between said drag strap and said circumferential contact surface.

6. An exercise apparatus according to claim 1, further comprising:

a right foot skate track disposed along a right side of said treadmill and designed to selectively constrain movement of said right foot skate to a straight path along the right side of said treadmill; and a left foot skate track disposed along a left side of said treadmill and designed to selectively constrain movement of said left foot skate to a straight path along the left side of said treadmill.

7. An exercise apparatus according to claim 6, wherein each said skate track has a channel formed therein, and each said skate has a flange designed to mate with a respective channel to movably constrain a respective skate to a respective skate track.

8. An exercise apparatus according to claim 1, wherein said base is supported above a floor surface by front legs having an adjustable effective length.

9. An exercise apparatus according to claim 1, further comprising:

a right foot pedal pivotally mounted relative to said base proximate said front end; and a left foot pedal pivotally mounted relative to said base proximate said front end.

10. An exercise apparatus according to claim 9, further comprising a pedal reciprocating means, operatively connected to said right foot pedal and said left foot pedal, for causing said right foot pedal and said left foot pedal to pivot up and down in reciprocating fashion.

11. An exercise apparatus according to claim 9, further comprising a pedal resistance means, operatively connected to said right foot pedal and said left foot pedal, for resisting pivoting of said right foot pedal and said left foot pedal.

12. An exercise apparatus according to claim 9, wherein each said pedal pivots to a storage position and may be selectively latched in said storage position.

13. An exercise apparatus according to claim 1, wherein each said one-way clutch roller means includes a front wheel assembly having a one-way clutch associated therewith, and each said one-way clutch roller means includes a rear wheel assembly having a one-way clutch associated therewith.

14. An exercise apparatus, comprising:

a base extending from a first end to a second end;

a treadmill operatively mounted relative to said base and within the dimensions of said base;

a right foot skate selectively in rolling engagement with said treadmill;

a left foot skate selectively in rolling engagement with said treadmill;

a right foot skate track disposed outside a right side of said treadmill and designed to selectively constrain movement of said right foot skate to a straight path along said right side of said treadmill; and a left foot skate track disposed outside a left side of said treadmill and designed to selectively constrain movement of said left foot skate to a straight path along said left side of said treadmill.

15. An exercise apparatus according to claim 14, wherein each said skate track has a T-shaped channel formed therein, and each said skate has a T-shaped flange designed to mate with a respective T-shaped channel to movably constrain a respective skate to a respective skate track.

16. An exercise apparatus according to claim 15, wherein each said T-shaped channel extends to at least one end of a respective skate track to provide an accessible T-shaped opening into which a respective T-shaped flange may be inserted.

17. An exercise apparatus according to claim 14, wherein each said skate includes at least one one-way clutch roller designed to allow a respective skate to roll forward relative to said treadmill and to prevent a respective skate from rolling rearward relative to said treadmill.

18. An exercise apparatus, comprising:

a right foot skate having a one-way clutch roller for allowing said right foot skate to roll in a forward direction across a surface and for preventing said right foot skate from rolling in an opposite, rearward direction across said surface;

a left foot skate having a one-way clutch roller for allowing said left foot skate to roll in said forward direction across said surface and for preventing said left foot skate from rolling in said rearward direction across said surface;

a rotatable continuous loop disposed directly beneath said right foot skate and said left foot skate, wherein said surface is an upwardly facing portion of said continuous loop, and movement of said right foot skate in said rearward direction requires coincidental movement of said surface in said rearward direction, and movement of said left foot skate in said rearward direction requires coincidental movement of said surface in said rearward direction.

19. An exercise apparatus according to claim 18, further comprising:

a right skate constraining means, disposed on a right side of said continuous loop, for constraining movement of said right foot skate to said forward direction and said rearward direction; and a left skate constraining means, disposed on a left side of said continuous loop, for constraining movement of said left foot skate to said forward direction and said rearward direction.

20. An exercise apparatus according to claim 19, wherein each said constraining means includes a track with a channel formed therein, said channel having a substantially T-shaped profile, and each said skate includes a rail having a mating substantially T-shaped profile that is designed to slide within a respective channel.

* * * * *